US008689452B2

(12) United States Patent
Truong

(10) Patent No.: US 8,689,452 B2
(45) Date of Patent: Apr. 8, 2014

(54) FOAM GROOVING SLED

(76) Inventor: Tina V. Truong, Mississauga, CA (US)

( * ) Notice: Subject to any disclaimer, the term of this patent is extended or adjusted under 35 U.S.C. 154(b) by 900 days.

(21) Appl. No.: 12/566,140

(22) Filed: Sep. 24, 2009

(65) Prior Publication Data

US 2010/0011591 A1 Jan. 21, 2010

Related U.S. Application Data

(63) Continuation-in-part of application No. 11/859,798, filed on Sep. 24, 2007, now abandoned.

(51) Int. Cl.
*B26D 3/06* (2006.01)
*B26B 3/00* (2006.01)

(52) U.S. Cl.
USPC ..... 30/279.6; 30/140; 30/279.2; 30/282; 30/287; 30/289; 30/293; 30/294; 30/314; 83/171; 83/875

(58) Field of Classification Search
USPC ..... 30/293, 140, 278, 279.2, 279.6, 280, 30/282–294, 305, 314, 315, 317; 83/614, 83/875, 15, 16, 171; 144/136.1, 136.9, 144/136.95; 219/221, 227, 233, 533
See application file for complete search history.

(56) References Cited

U.S. PATENT DOCUMENTS

| | | | | | |
|---|---|---|---|---|---|
| 1,915,636 | A | * | 6/1933 | Wendelken | 30/122 |
| 1,956,275 | A | * | 4/1934 | Cook | 30/293 |
| 3,274,868 | A | * | 9/1966 | Williams | 409/304 |
| 3,821,849 | A | | 7/1974 | Grinnon | |
| 3,934,341 | A | * | 1/1976 | Carlson | 30/287 |
| 3,935,767 | A | * | 2/1976 | McClay, Jr. | 409/293 |
| 4,180,908 | A | * | 1/1980 | Beermann | 30/279.6 |
| 4,608,902 | A | * | 9/1986 | Ivey | 83/875 |
| 4,797,999 | A | * | 1/1989 | Van Alstine | 30/140 |
| 4,983,081 | A | * | 1/1991 | Cunningham, Jr. | 83/39 |
| 5,040,297 | A | | 8/1991 | Scheinost | |
| 5,077,899 | A | * | 1/1992 | Rancour et al. | 30/287 |
| 6,230,410 | B1 | * | 5/2001 | Taylor et al. | 30/293 |
| 6,905,290 | B1 | | 6/2005 | Casciato, Jr. | |

FOREIGN PATENT DOCUMENTS

| | | | | |
|---|---|---|---|---|
| EP | 0 297 684 | * | 1/1989 | 83/875 |

* cited by examiner

*Primary Examiner* — Clark F. Dexter
(74) *Attorney, Agent, or Firm* — Miltons IP/p.i.

(57) ABSTRACT

A grooving sled for use with a pre-formed groove blade and hot knife, for making grooves in expanded polystyrene foam boards or walls. The grooving sled includes a built-in straight edge guide, one of two cutting position margins, and a stabilizer plate that fits inside a freshly-cut groove to keep the grooving sled straight while operating along the cutting layout line established on the board or wall. The stabilizer plate aligns with the groove blade by use of an angular adjuster, and if necessary, an insert bar. The stabilizer plate can also be adjusted vertically.

19 Claims, 8 Drawing Sheets

1
55
10
50

57, 58
55
1
50
75
80

80
75

75
80

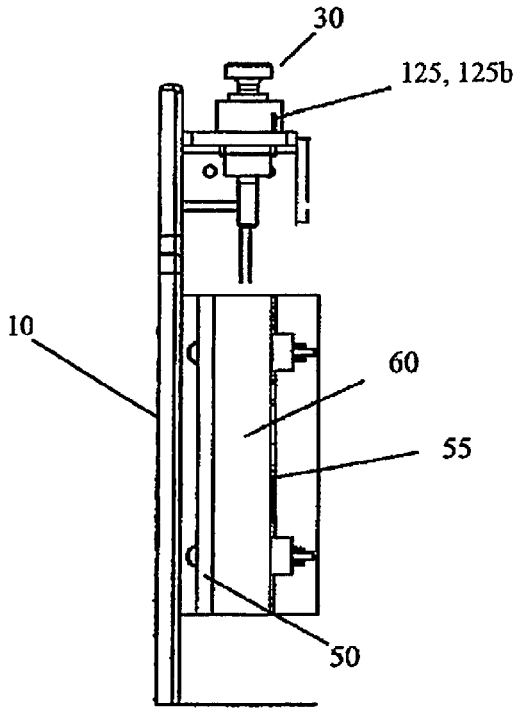
FIG. 5
FIG. 6
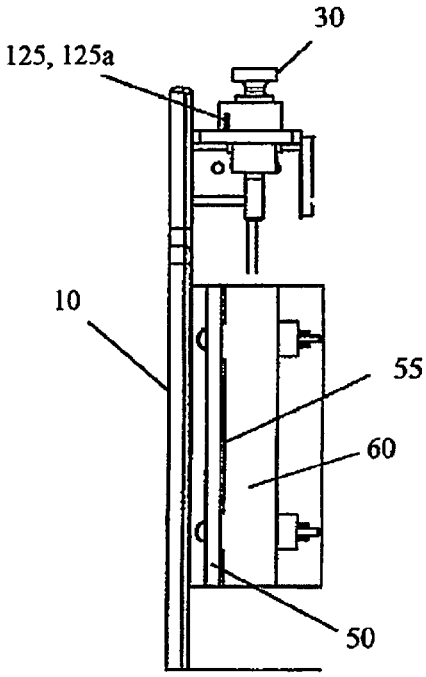

FOAM GROOVING SLED

This application is a continuation application of U.S. application Ser. No. 11/859,798 filed Sep. 24, 2007, now abandoned.

FIELD OF THE INVENTION

This invention relates generally to construction hand tools, and more particularly, to a grooving sled holding a preformed blade which is attached to a hot knife that melt strips of Expanded Polystyrene (EPS) foam board to produce a controlled groove.

BACKGROUND OF THE INVENTION

There are a wide variety of hand tools currently available for scoring/etching grooves in construction material. These tools include a variety of hand saws, rasps, utility knives and electrical hot knives for scoring, etching and/or grooving exterior finish insulation systems. The exterior finish insulation system is subsequently coated with cement or mortar.

The exterior finish insulation system is an insulating material generally manufactured from polystyrene (or other similar material, such as Styrofoam®) mounted onto the frame of a building under construction. This exterior insulation provides both insulation as well as a foundation for the exterior finish of the building. After installation, the insulation surface is scored, etched or grooved to accommodate the functional and/or decorative markings required by building code or aesthetic design. For example, decorative grooves, such as geometric designs or trade name indicia, are formed and defined by scoring/etching the insulation.

U.S. Pat. No. 6,905,290 (Casciato) discloses a hand rasp that comprises a planar plate with a removably affixed straight edge guide, and a groove blade that is removably affixed to the posterior surface of the plate. The operator pushes and pulls the rasp in a back-and-forth motion until the desired groove is scored or etched into the construction material. This tool is does not melt EPS foam material and requires the use of a 3-dimensional blade and affixing means attached to the blade.

In order to score, etch or groove the insulation surface, many construction professionals use hand saws or hand rasps. However, each of these presents several disadvantages in terms of waste (of both time and construction material) and dangerous use. For example, hand saws and rasps consist of large blades, making both tools clumsy and dangerous to use at elevated heights. In addition, any minor imprecision in the use of the blade results in irreparable damage to the insulation.

While an electrical hot knife is more advantageous for scoring, etching and/or grooving at elevated heights than either a hand saw or rasp, conventional electrical hot knives present several shortcomings for the construction professional. One typical hot knife tool consists of a sled and two adjustable groove blade holders. The adjustable blade holders are located on one edge of the sled, and can slide freely thereon. Each end of a groove blade is then attached to a respective blade holder, and the latter are then fixed into position before operation. Shapes of groove blades include, for example, square, round or "U", bevel, angle and "V".

Before operating the grooving sled, the operator first marks the segment for grooving/etching or scoring by drawing a cutting line on the insulation material. Once the groove blade is attached to the sled, the operator then measures the distance between the straight edge guide of the sled and the blade holder nearest to the straight edge guide. This distance is called the "cutting margin". Another line, called the "guide line" is then drawn parallel to the cutting line at a distance equal to the cutting margin. Unfortunately, every time a new groove blade is installed onto the sled, the operator will need to measure the new cutting margin; this is due to the fact that both of the blade holders have an adjustable position.

Another drawback of conventional grooving sleds is the requirement of an external straight edge guide along which the sled is guided. The straight edge guide is placed close to the guide line, and the grooving sled slides along the straight edge guide to melt strips of EPS foam board and creates a controlled groove. While performing this procedure, the operator needs to use both hands: one hand to hold the straight edge guide, and the other hand to hold the grooving sled. At the same time, the operator will need to move along the wall to follow the guide. In addition, such an operation occurs at heights, requiring the operator to concentrate on the grooving sled, the straight edge guide, the guideline, and maintaining one's balance.

There is therefore a need for a tool for the grooving, etching or scoring of external insulation material that is both simple and stable to use. Such a device should not require the use of an external straight edge guide; it should allow for quick use when changing groove blades without the need to measure the cutting margin; and should provide for a steady, stable grooving motion when in operation.

SUMMARY OF THE INVENTION

The present invention relates to an improved foam grooving sled that has a built-in straight edge guide to give the operator a free hand eliminating the need to use an external wood or steel stud to act as a straight edge guide.

The foam grooving sled also has a fixed blade holder positioned on the left side to provide a fixed margin from the edge of the grooving sled to the groove cutting line. Thus, it will eliminate the need to measure the left margin every time the grooving blade changes.

The foam grooving sled of the present invention also includes a stabilizer plate that stabilizes the grooving sled into a straight line motion during operation.

In one aspect of the present invention, there is provided a grooving sled for making a groove in a foam insulation board, the grooving sled comprising: a) a hot-knife holder; b) a built-in straight edge guide; c) a frontal edge perpendicular to the built-in straight edge guide; d) a first blade holder for receiving a first end of a groove blade; the first blade holder being fixed proximally to the straight edge guide and providing a cutting margin from the straight edge guide; e) a second blade holder for receiving a second end of the groove blade; the second blade holder being distal to the built-in straight edge guide and adjustable to a fixed position along the frontal edge; f) a stabilizer plate, with a portion thereof extending below an anterior surface of the grooving sled, the portion being insertable into a groove formed by the first end of the groove blade during operation of the grooving sled; and g) alignment means for aligning the stabilizer plate with the first end of the groove blade, the alignment means comprising: i) an angle adjuster mounted adjacent to the straight edge guide for angular alignment of the stabilizer plate with an angle of the first end of the groove blade; and ii) an insert plate; wherein the stabilizer plate is mounted adjacent to the angular adjuster, or mounted in between the angular adjuster and the insert plate.

Preferably, the first blade holder is further adapted to provide a first position for a cutting margin which is proximal to the straight edge guide, and a second position for the cutting margin that is distal to the straight edge guide. The first position and second position are preferably ½ inch and 1 inch, respectively. The portion of the stabilizer plate preferably extends to a maximum of half the depth of the groove blade, and preferably comprises an extension that fits into the groove formed by the groove blade during operation. The angle adjuster preferably comprises a semi-circular bar and a concave rectangular bar that mounts onto an external radial surface of the semi-circular bar. The angle adjuster has a preferable range of from 45° to 90°. In addition, the grooving sled can receive groove blades that are straight angle, bevel, V-shaped or U-shaped.

When the groove blade is bevel or V-shaped, the stabilizer plate is mounted adjacent to the angle adjuster, and the first blade holder is at the second position. When the groove blade is straight-angle or U-shaped, the first blade holder is at the second position, the angle adjuster is at 90°, the insert bar is mounted adjacent to the angle adjuster, and the stabilizer plate is mounted adjacent to the insert bar. When the groove blade is straight-angle or U-shaped, and has a width that exceeds a minimum separation distance between the first position of the first blade holder and the second blade holder, the first blade holder is at the first position, the angle adjuster is at 90°, and the stabilizer plate is mounted adjacent to the angle adjuster.

In another aspect of the present invention, there is provided a grooving sled for forming a groove in a foam insulation board, the grooving sled comprising: a) a hot-knife holder; b) a built-in straight edge guide; c) a frontal edge perpendicular to the built-in straight edge guide; d) a first blade holder for receiving a first end of a groove blade; the first blade holder being fixed proximally to the straight edge guide and adapted to provide a first position for a cutting margin at ½ inch from the straight edge guide, and a second position for the cutting margin at 1 inch from the straight edge guide; e) a second blade holder for receiving a second end of the groove blade; the second blade holder being distal to the built-in straight edge guide and adjustable to a fixed position along the frontal edge; f) a stabilizer plate, with a portion thereof extending below an anterior surface of the grooving sled a distance not greater than a depth of the groove blade, the portion being insertable into a groove formed by the first end of the groove blade during operation of the grooving sled; and g) alignment means for aligning the stabilizer plate with the first end of the groove blade, the alignment means comprising: i) an angle adjuster mounted adjacent to the straight edge guide for angular alignment of the stabilizer plate with an angle of the first end of the groove blade; and ii) an insert plate; wherein the stabilizer plate is mounted adjacent to the angular adjuster, or mounted in between the angular adjuster and the insert plate.

The portion of the stabilizer plate preferably extends to a maximum of half the depth of the groove blade, and preferably comprises an extension that fits into the groove formed by the groove blade during operation. The angle adjuster preferably comprises a semi-circular bar and a concave rectangular bar mounted onto an external radial surface of the semi-circular bar. In addition, the angle adjuster has a range of 45° to 90°.

The grooving sled can receive a groove blade that is straight-angle, bevel, V-shaped or U-shaped. In the case where the groove blade is bevel or V-shaped, the stabilizer plate is mounted adjacent to the angle adjuster, both the stabilizer plate and angle adjuster are set to the angle of the bevel- or V-shaped blade, and the cutting margin is at 1 inch. In the case where the groove blade is straight-angle or U-shaped, the cutting margin is at 1 inch, the angle adjuster is at 90°, the insert bar is mounted adjacent to the angle adjuster, and the stabilizer plate is mounted adjacent to the insert bar. In the case where the groove blade is straight-angle or U-shaped, and has a width greater than the minimum separation distance between the first position of the first blade holder and the second blade holder, the cutting margin is at 1 inch, the angle adjuster is at 90°, and the stabilizer plate is mounted adjacent to the angle adjuster. The minimum separation distance is preferably ¾ inch.

Wherever ranges of values are referenced within this specification, sub-ranges therein are intended to be included within the scope of the invention unless otherwise indicated. Where characteristics are attributed to one or another variant of the invention, unless otherwise indicated, such characteristics are intended to apply to all other variants of the invention where such characteristics are appropriate or compatible with such other variants.

Other objects and advantages of the apparatus and methods disclosed herein will be apparent to those of ordinary skill in the art upon perusal of the following Drawings and Detailed Description.

BRIEF DESCRIPTION OF THE DRAWINGS

FIG. 2A is a side view of the grooving sled of FIGS. 1A and 1B, while

FIG. 5 is a partial top plan view of a grooving sled showing a first position for the cutting margin and placement of the stabilizer plate and insert bar for straight angle grooves.

FIG. 6 is a partial top plan view of a grooving sled showing an optional position for the cutting margin and placement of the stabilizer plate and insert bar for straight angle grooves having a width greater than 3A inch.

DESCRIPTION OF THE PREFERRED EMBODIMENT

Figure 1A:
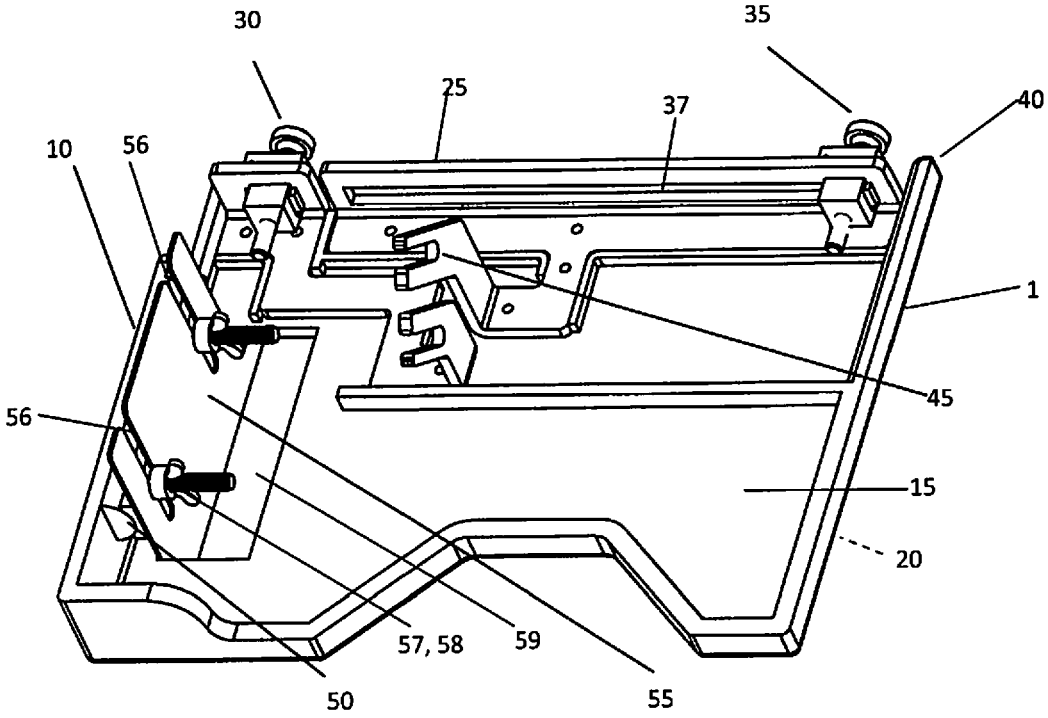
FIGS. 1A and 1B are each a top perspective view of one embodiment of the grooving sled of the present invention.
Figure 1B:
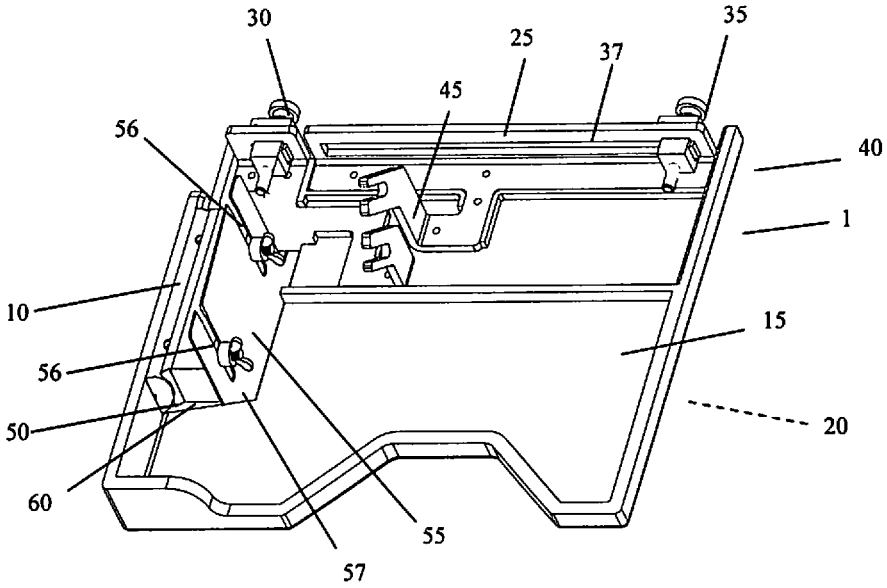

FIGS. 1A and 1B are each a top perspective view of one embodiment of the grooving sled (1) of the present invention. The grooving sled (1) has a posterior surface (15) and anterior surface (20). A built-in straight edge guide (10) is perpendicular to a frontal edge (25) of the grooving sled (1). The built-in straight edge guide (10) acts as a straight edge guide to follow the guide line on the wall (not shown). Located along the frontal edge (25) are a fixed blade holder (30) and adjustable blade holder (35). The fixed blade holder (30) is proximal to the built-in straight edge guide (10), while the adjustable blade holder (35) is distal to the built-in straight edge guide (10). The adjustable blade holder (35) can be positioned anywhere in between the fixed blade holder (30) and the distal edge (40) of the grooving sled (1), by sliding along, for example, a sliding bar (37).

The blade holders (30) and (35) receive a groove blade (not shown). The grooving sled also includes a hot knife holder (45), to which is attached a standard hot knife (not shown).

A stabilizer plate (55) is used to prevent the grooving sled (1) from moving right or left while it is in use to cut the groove in the wall. A portion of the stabilizer plate (55) extends below the anterior surface (25) through an aperture (59). It is this portion (see FIGS. 2A and 2B) which fits inside a freshly-cut groove (not shown), thereby stabilizing the grooving sled (1) while in operation. That is, this portion follows into the freshly cut groove after the groove blade, thereby preventing the grooving sled from moving left or right while the operator slides the grooving sled (1) along the groove cutting line (not shown).

In order to fit into the freshly cut groove, it follows that the stabilizer plate (55) cannot extend vertically beyond the straight or angle portion of the groove blade. For example, when a U-shaped blade is used, the stabilizer plate can extend only to the depth of the groove blade that is straight. Beyond this depth, the groove blade assumes a semi-circular shape, and thereby etches or scores a similar pattern in the wall foam board—the stabilizer plate cannot fit into the semi-circular portion of the groove formed by the U-shaped blade. Vertical adjustment of the stabilizer plate (55) can be accomplished by means of vertical slots (56). The operator must ensure that the stabilizer plate (55) does not extend vertically beyond the groove blade depth. Preferably, the stabilizer plate (55) is adjusted to extend no more than half the groove blade depth.

In addition, the stabilizer plate (55) must be aligned with the groove blade portion (not shown) received by the fixed blade holder (30). Adjacent to the built-in straight edge guide (10) is an angle adjuster (50). The angle adjuster (50) is used for angular alignment of the stabilizer plate (55) with the groove blade (not shown). The angle adjuster (50) can tilt the stabilizer plate (55) between 90° and, preferably, 45°. In FIGS. 1A and 1B, the stabilizer plate (55) is vertical, i.e. at 90°. The stabilizer plate (55) may be attached to the angular adjuster (50) using, for example, but not limited to, standard pivoting bolt and wing nuts (57, 58).

In FIG. 1B, an insert bar (60) is attached adjacent to the angle adjuster (50), with the stabilizer plate (55) attached adjacent to the insert bar (60) for alignment with a groove blade (not shown).

Bevel or V groove blades are used with the configuration shown in FIG. 1A, while straight-angle and U-shaped groove blades can be used with the configuration shown in either FIG. 1A or 1B.

The fixed blade holder (30) is adapted to allow for two positions for cutting margins (125). A first position (125*a*) is proximal to the built-in straight edge guide (10), while a second position (125*b*) is distal. The first position (125*a*) allows for grooves that need to be made closer to the edge of the wall. This feature is further illustrated in FIGS. 5 and 6, having a fixed margin position at, for example, at ½" or 1", eliminates the need to measure the cutting margin when changing the grooving blade.

Figure 2A:
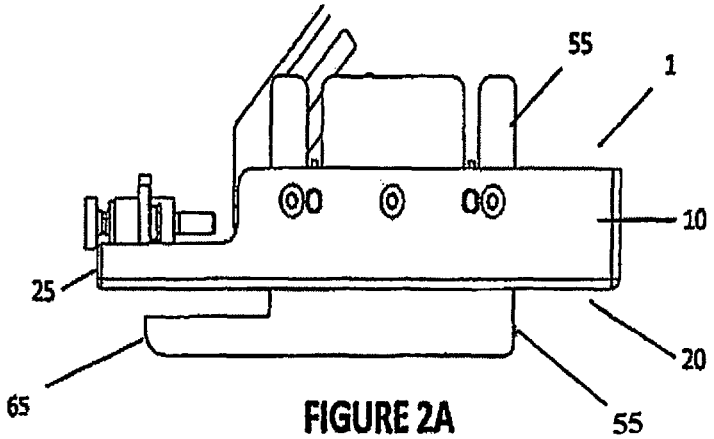

FIG. 2A is a side view of the foam grooving sled (1) of FIGS. 1A and 1B. The stabilizer plate (55) extends below the anterior surface (20) of the grooving sled to go inside the groove to keep the straight edge guide securely in place, preventing the grooving sled from moving left or right while the operator follows the straight grooving line on the wall.

Figure 2B:
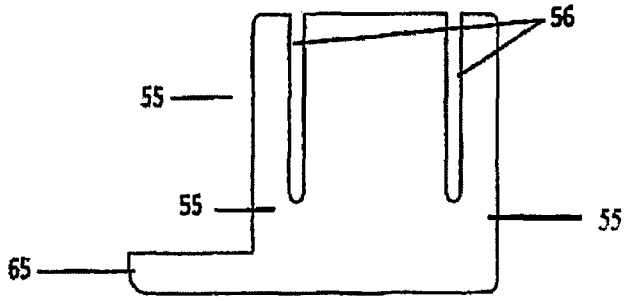
FIG. 2B is a side view of the stabilizer plate shown in FIG. 2A.

In addition, an extension element (65) of the stabilizer plate (55) is shown. The extension element (65) extends towards the front of the grooving sled (1), and inserts smoothly into a freshly cut groove (not shown) as the operator cuts along the groove cutting line (not shown), thereby stabilizing the grooving sled (1) from moving right or left, and thus keeping the built-in straight edge guide (10) securely in place as the operator follows the grooving layout line (not shown). In FIG. 2B, a planar view of the stabilizer plate (55) shows the vertical slots (56) of the stabilizer plate (55) used for vertical adjustment of the stabilizer plate (55).

Figure 3:
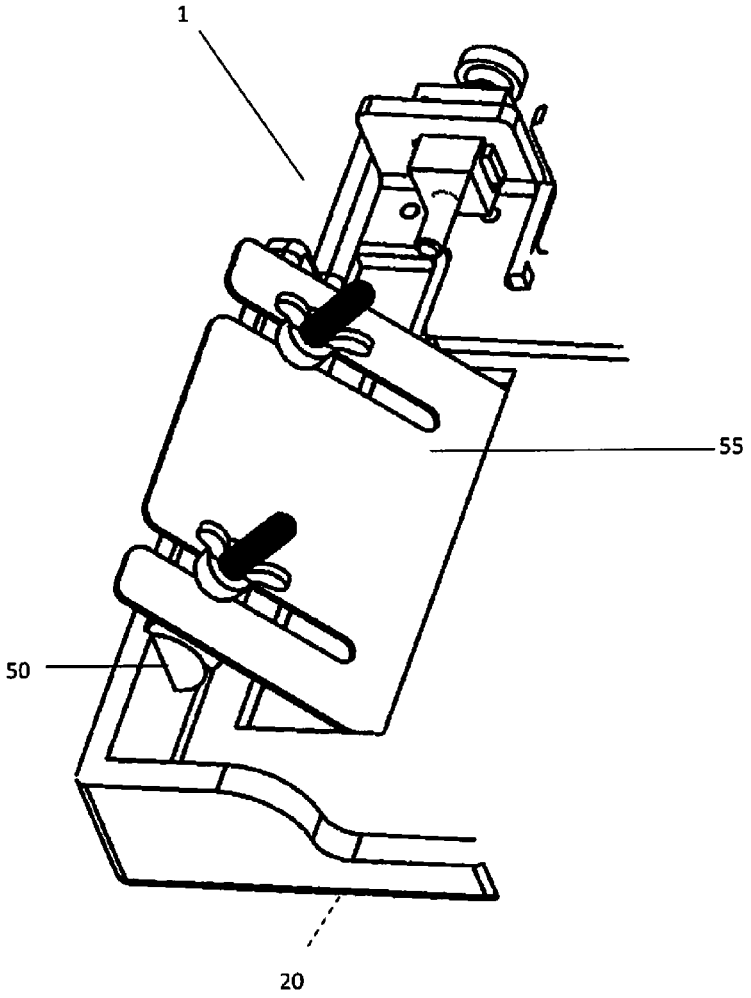
FIG. 3 is a partial view of the grooving sled of FIG. 1A, showing the stabilizer plate at a 45° angle.

FIG. 3 illustrates a partial view of the grooving sled (1) of FIG. 1A, showing the stabilizer plate (55) at a 45° angle. The angle adjuster (50) is tilted to a 45° angle, thereby tilting the stabilizer plate (55) to a 45° angle. This configuration is used for a bevel or V groove blade (not shown) with a 45° angle. This configuration of the stabilizer plate (55) allows for the angular alignment of the stabilizer plate (55) with a 45° V groove blade (not shown). As the operator uses the sled along the groove cutting line (not shown), the extension element (not shown), which is beneath the anterior surface (20) of the grooving sled, fits snugly into the freshly-cut groove made by the 45° V groove blade (not shown).

Figures 4A, 4B, 4C, 4D, 4E:
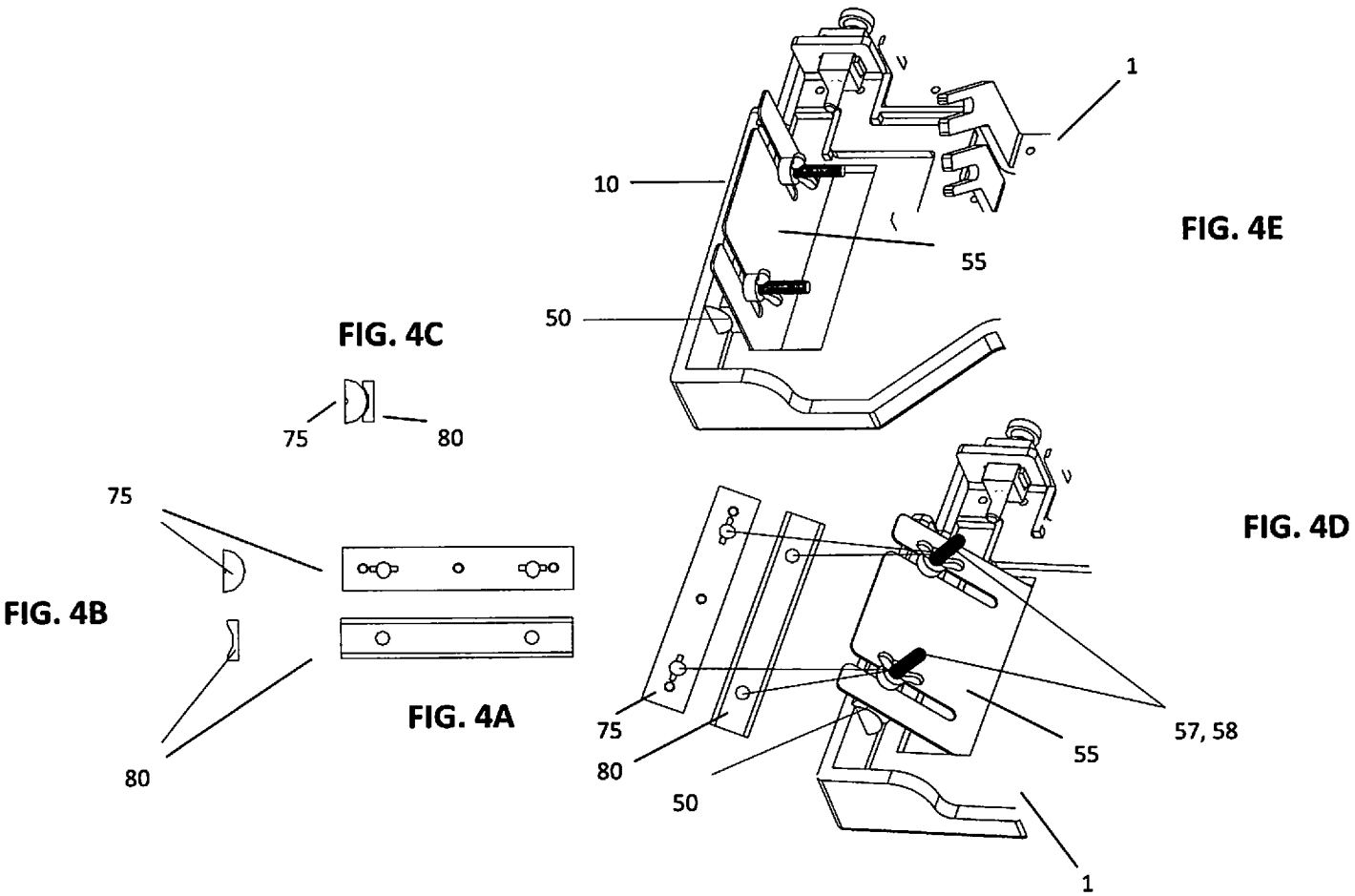
FIGS. 4A-4E illustrate the components and function of an angle adjuster.

FIGS. 4A-4E illustrate the components and function of the angle adjuster (50) of the present invention. FIGS. 4A and 4B illustrate a front and side view, respectively, of components which comprise the angle adjuster (50) of the present invention. The angle adjuster (50) comprises a semi-circular bar (75) and concave rectangular bar (80) which mounts onto the semi-circular bar (75). The radius of the semi-circular bar (75) is equal to the concave radius of the rectangular bar (80). As shown in FIG. 4C, the concave rectangular bar (80) can move along the semi-circular portion of the semi-circular bar (75), while the semi-circular bar (75) remains in a fixed position.

The angular adjuster (50) is mounted onto the grooving sled (1) as follows: the semi-circular bar (75) is mounted adjacent to the straight edge guide (10), while the concave rectangular bar (80) is placed in between the semi-circular bar (75) and the stabilizer plate (55). The three elements are then tightened onto the built-in straight edge guide (10), by using, for example, the pivoting bolts (57) and wing nuts (58). The pivoting bolts (57) can be moved up or down, thereby moving the concave rectangular bar (80) along the radius of the semi-circular bar (75), which in turn tilts the stabilizer plate (55). In FIG. 4D, the stabilizer plate (55) is tilted to an angle which lines up with angle of the bevel or V groove blade (not shown). As shown in FIG. 4E, the stabilizer plate (55) is kept at 90° for a straight-angle groove blade.

FIGS. 5 and 6 are each a top plan view of a grooving sled of the present invention, showing two positions for the cutting margins (125), and the respective configurations of the stabilizer plate (55) and insert bar (60) for a straight-angle or U-shape groove blade. The fixed blade holder (30) is adapted to allow for one of two positions for the cutting margin (125). In this embodiment, the fixed blade holder (30) can simply be removed, turned around, and re-attached to the grooving sled (1), to allow for two different cutting margin positions. The first (125*a*) and second (125*b*) positions for the cutting margin (125) are preferably ½ inch and 1 inch, respectively. This eliminates the need to measure the cutting margin (125) every time the operator changes the groove blade.

FIG. 5 illustrates the second position which is a straight angle (square, round or U) blade position (125*b*) that has 1" left margin (125). The groove cutting blade (not shown) is inserted into the right side of the fixed blade holder (30). The insert bar (60) is adjacent to the angle adjuster (50), while the stabilizer plate (55) is adjacent to the insert bar (60) in this configuration.

The insert bar (60) is preferably a rectangular bar (60) which allows the stabilizer plate (55) to line up with the straight angle groove cutting line.

FIG. 6 illustrates the first position which is an optional blade position (125*a*) of the cutting margin (125) at ½" inch. This configuration is for straight angle groove blades of ¾" or greater in width. The groove cutting blade (not shown) is inserted into the left side of the fixed blade holder (30). The stabilizer plate (55) is adjacent to the angle adjuster (50), while the insert bar (60) is adjacent to the stabilizer plate (55) in this configuration.

Figure 7A:
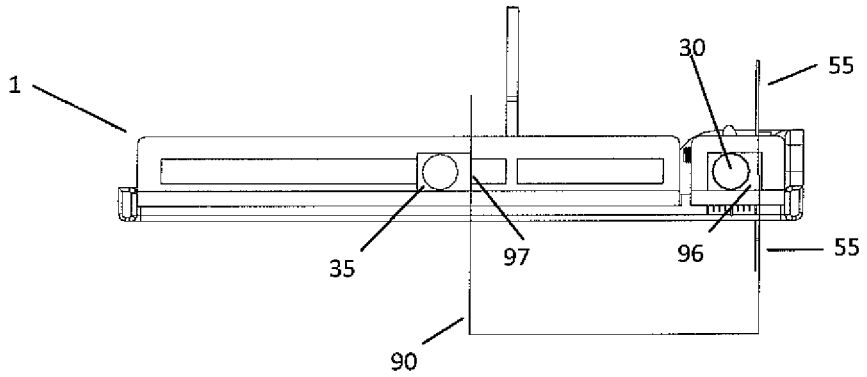
FIGS. 7A and 7B illustrate a front view and rear view, respectively, of the grooving sled shown in FIG. 6, with a straight-angle groove blade.
Figure 7B:
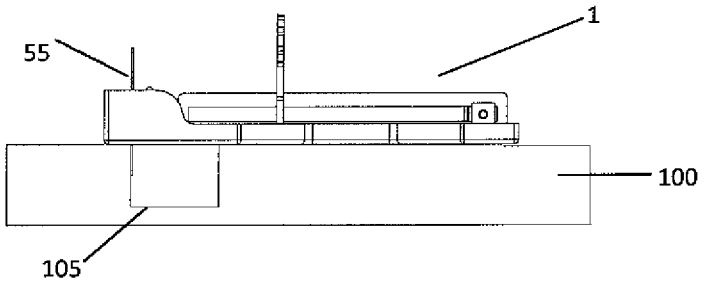

The manner in which the stabilizer plate (55) of a grooving sled (1) of the present invention is aligned with a straight-angle groove blade (90), is shown in FIGS. 7A and 7B. In FIG. 7A, a first end (96) of the straight-angle groove blade (90) is attached to the fixed-blade holder (30), while a second end (97) of the straight-angle groove blade (90) is attached to the adjustable blade holder (35). The stabilizer plate (55) is at 90°, and aligned with the first end (96) of the straight-angle groove blade (90). In addition, the stabilizer plate (55) extends vertically no more than half the depth of the straight-angle groove blade (90).

In FIG. 7B, the grooving sled (1) configuration of FIG. 7A is seen from the rear as it is applied to a foam board (100). A groove (105) is made in the foam board (100) by the straight-angle groove blade (not shown), into which the stabilizer plate (55) snugly fits, thereby stabilizing the grooving sled (1) from moving left or right while in use.

Figure 8:
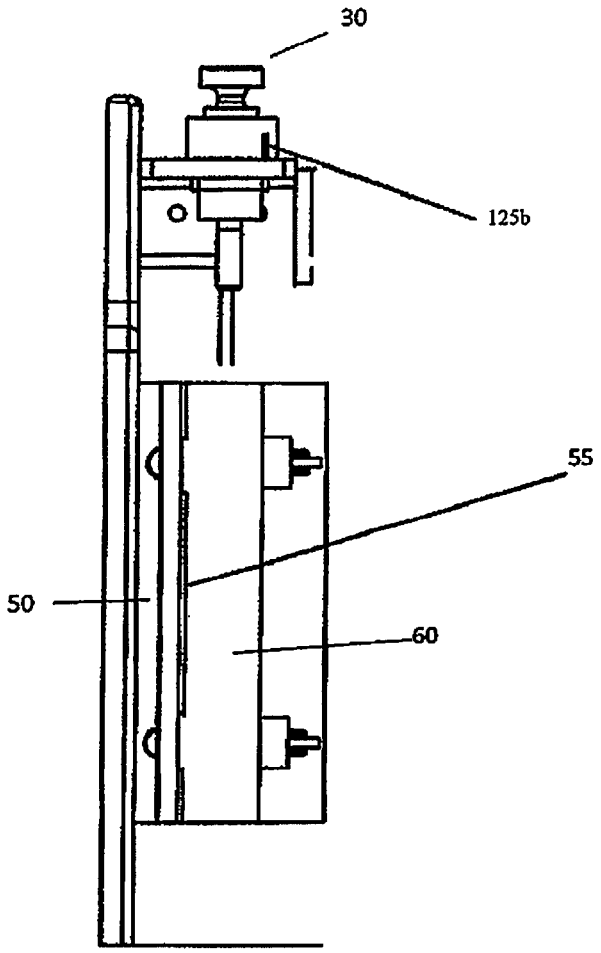
FIG. 8 is a partial top plan view of the configuration of a grooving sled position for bevel or V grooves.

FIG. 8 illustrates a bevel or V grooving blade position (125*b*) that has 1" left margin. In order to achieve proper alignment between the stabilizer plate (55) and the bevel or V-shaped groove blade, a cutting margin (125) and blade position (125*b*) of 1 inch is used, while the stabilizer plate (55) is set adjacent to the angle adjuster (50). While the insert bar is not required in this configuration, FIG. 8 illustrates that the insert bar (60) can be optionally used for this configuration.

Figure 9A:
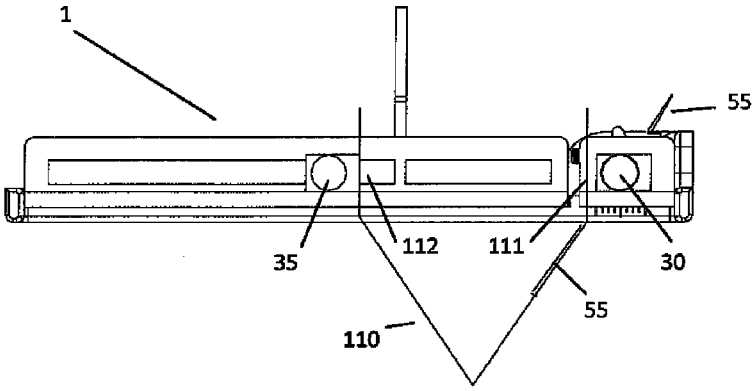
FIGS. 9A and 9B illustrate a front view and rear view, respectively, of the grooving sled shown in FIG. 8, with a bevel groove blade.
Figure 9B:
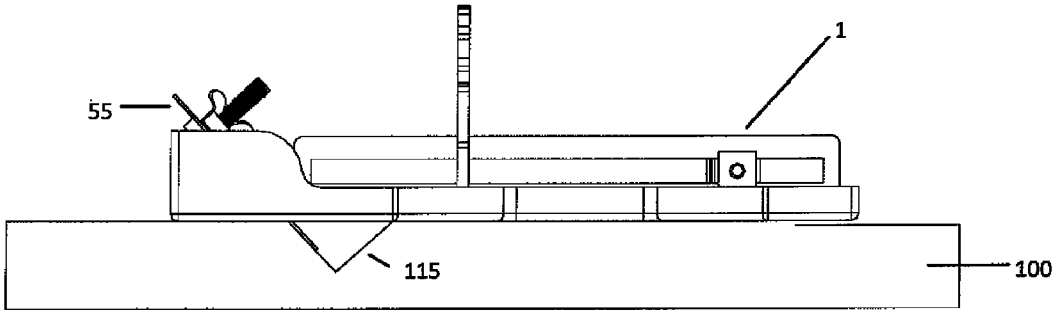

The manner in which the stabilizer plate (55) of the grooving sled (1) of the present invention is aligned with a bevel or V groove blade (110) is further shown in FIGS. 9A and 9B. In FIG. 9A, a first end (111) of the V-shaped groove blade (110) is attached to the fixed-blade holder (30), while a second end (112) of the V-shaped groove blade (110) is attached to the adjustable blade holder (35). The stabilizer plate (55) is tilted at an angle equal to that of the V groove blade (110) and aligned with the first end (111) of the V groove blade (110). In addition, the stabilizer plate (55) extends below the anterior surface of the grooving sled (1) no more than half the length of the V-shaped groove blade (110).

In FIG. 9B, the grooving sled (1) configuration of FIG. 9A is seen from the rear as the grooving sled operates on the foam board (100). A V-shaped groove (115) is made in the foam board (100) by the V-shaped groove blade (not shown), into which the stabilizer plate (55) snugly fits, thereby stabilizing the grooving sled (1) from moving left or right while in use.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

I claim:

1. A grooving sled for making a groove in a foam insulation board, said grooving sled comprising:

a) a hot-knife holder;

b) a straight edge guide;

c) a frontal edge perpendicular to said straight edge guide;

d) a first blade holder for receiving a first end of a groove blade, said first blade holder being fixed proximally to said straight edge guide and fixedly located along said frontal edge for providing a cutting margin from said straight edge guide;

e) a second blade holder for receiving a second end of said groove blade, said second blade holder being distal to said straight edge guide and adjustably located along said frontal edge, wherein said second blade holder is fixable in a position along said frontal edge;

f) a stabilizer plate, with a portion thereof extending below an anterior surface of said grooving sled, said portion insertable into a groove formed by said groove blade during operation of said grooving sled; and g) alignment means for aligning said stabilizer plate with said first end of said groove blade, said alignment means comprising:

i) an angle adjuster mounted adjacent to said straight edge guide, said angle adjuster angularly adjustably supporting said stabilizer plate for angular alignment of said stabilizer plate with an angle of said first end of said groove blade; and ii) an insert bar;

wherein said stabilizer plate is mounted adjacent to said angle adjuster, or mounted in between said adjuster and said insert bar.

2. The grooving sled of claim 1, wherein said first blade holder is further adapted to provide a first position for said cutting margin that is proximal to said straight edge guide, and a second position for said cutting margin that is distal to said straight edge guide.

3. The grooving sled of claim 2, further including a groove blade mounted to said first and second blade holders, wherein said groove blade is bevel or V-shaped, said stabilizer plate is mounted adjacent to said angle adjuster, and said first blade holder is at said second position.

4. The grooving sled of claim 2, further including a groove blade mounted to said first and second blade holders, wherein said groove blade is straight-angle or U-shaped; said first blade holder is at said second position; said angle adjuster is at 90°; said insert bar is mounted adjacent to said angle adjuster; and said stabilizer plate is mounted adjacent to said insert bar.

5. The grooving sled of claim 2, further including a groove blade mounted to said first and second blade holders, wherein said groove blade is straight-angle or U-shaped, and has a width that exceeds a minimum separation distance between said first position of said first blade holder and said second blade holder; said first blade holder is at said first position; said angle adjuster is at 90°; and said stabilizer plate is mounted adjacent to said angle adjuster.

6. The grooving sled of claim 1, further including a groove blade mounted to said first and second blade holders, wherein said portion of said stabilizer plate extends to a maximum of half a depth of said groove blade.

7. The grooving sled of claim 1, wherein said portion of said stabilizer plate comprises an extension.

8. The grooving sled of claim 1, wherein said angle adjuster comprises a semi-circular bar and a concave rectangular bar mounted onto an external radial surface of said semi-circular bar.

9. The grooving sled of claim 1, wherein said angle adjuster has a range of 45° to 90°.

10. The grooving sled of claim 1, further including a groove blade mounted to said first and second blade holders, wherein said groove blade is straight-angle, bevel, V-shaped or U-shaped.

11. A grooving sled for making a groove in a foam insulation board, said grooving sled comprising:

a) a hot-knife holder;

b) a straight edge guide;

c) a frontal edge perpendicular to said straight edge guide;

d) a first blade holder for receiving a first end of a groove blade, said first blade holder being fixed proximally to said straight edge guide and fixedly located along said front edge for providing a first position for a cutting margin at ½ inch from said straight edge guide, and a second position for said cutting margin at 1 inch from said straight edge guide;

e) a second blade holder for receiving a second end of said groove blade, said second blade holder being distal to said straight edge guide and adjustably located along said frontal edge, wherein said second blade holder is fixable in a position along said frontal edge;

f) a stabilizer plate, with a portion thereof extending below an anterior surface of said grooving sled, said portion insertable into a groove formed by said groove blade during operation of said grooving sled; and g) alignment means for aligning said stabilizer plate with said first end of said groove blade, said alignment means comprising:

i) an angle adjuster mounted adjacent to said straight edge guide, said angle adjuster angularly adjustably supporting said stabilizer plate for angular alignment of said stabilizer plate with an angle of said first end of said groove blade; and ii) an insert bar; wherein said stabilizer plate is mounted adjacent to said angle adjuster, or mounted in between said angle adjuster and said insert bar.

12. The grooving sled of claim 11, wherein said portion of said stabilizer plate comprises an extension.

13. The grooving sled of claim 11, wherein said angle adjuster comprises a semi-circular bar and a concave rectangular bar mounted onto an external radial surface of said semi-circular bar.

14. The grooving sled of claim 11, wherein said angle adjuster has a range of 45° to 90°.

15. The grooving sled of claim 11, further including a groove blade mounted to said first and second blade holders, wherein said groove blade is straight-angle, bevel, V-shaped or U-shaped.

16. The grooving sled of claim 11, further including a groove blade mounted to said first and second blade holders, wherein said groove blade is bevel or V-shaped; said stabilizer plate is mounted adjacent to said angle adjuster; and said first blade holder is in said second position for said cutting margin at 1 inch.

17. The grooving sled of claim 11, further including a groove blade mounted to said first and second blade holders, wherein said groove blade is straight-angle or U-shaped; said first blade holder is in said second position for said cutting margin at 1 inch; said angle adjuster is at 90°; said insert bar is mounted adjacent to said angle adjuster; and said stabilizer plate is mounted adjacent to said insert bar.

18. The grooving sled of claim 11, further including a groove blade mounted to said first and second blade holders, wherein said groove blade is straight-angle or U-shaped, and has a width greater than a minimum separation distance between said first position and said second blade holder; said first blade holder is in said second position for said cutting margin at 1 inch; said angle adjuster is at 90°; and said stabilizer plate is mounted adjacent to said angle adjuster.

19. The grooving sled of claim 18, wherein said minimum separation distance is ¾ inch.

* * * * *